US010337826B2

(12) United States Patent
Pretelli et al.

(10) Patent No.: US 10,337,826 B2
(45) Date of Patent: Jul. 2, 2019

(54) STOCK FOR SHOTGUN

(71) Applicant: FUTURMEC S.R.L., Urbania (IT)

(72) Inventors: Walter Pretelli, Urbania (IT); Michele Sideri, Urbania (IT)

(73) Assignee: FUTURMEC S.R.L., Urbania (IT)

( * ) Notice: Subject to any disclaimer, the term of this patent is extended or adjusted under 35 U.S.C. 154(b) by 27 days.

(21) Appl. No.: 15/846,687

(22) Filed: Dec. 19, 2017

(65) Prior Publication Data

US 2018/0180378 A1 Jun. 28, 2018

(30) Foreign Application Priority Data

Dec. 27, 2016 (IT) ..... 102016000131282

(51) Int. Cl.

| | |
|---|---|
| ***F41A 11/02*** | (2006.01) |
| ***F41C 23/04*** | (2006.01) |
| ***F41C 23/10*** | (2006.01) |
| ***F41C 23/14*** | (2006.01) |
| ***F41C 23/20*** | (2006.01) |

(52) U.S. Cl.

CPC ..... *F41C 23/14* (2013.01); *F41A 11/02* (2013.01); *F41C 23/04* (2013.01); *F41C 23/10* (2013.01); *F41C 23/20* (2013.01)

(58) Field of Classification Search

CPC ..... F41C 11/02; F41C 23/04; F41C 23/10; F41C 23/14; F41C 23/20

See application file for complete search history.

(56) References Cited

U.S. PATENT DOCUMENTS

| | | | | |
|---|---|---|---|---|
| 2,956,343 | A | 10/1960 | Shafer | |
| 4,769,937 | A * | 9/1988 | Gregory | F41C 23/06 42/74 |
| 7,930,849 | B2 * | 4/2011 | Abraham | F41C 23/14 42/73 |
| 8,720,099 | B1 * | 5/2014 | Sisk | F41C 23/14 42/73 |
| 8,844,185 | B2 * | 9/2014 | Jarboe | F41C 23/04 42/73 |
| 9,417,032 | B1 | 8/2016 | Chiang | |

FOREIGN PATENT DOCUMENTS

| | | | |
|---|---|---|---|
| DE | 3743092 | A1 | 7/1988 |
| DE | 20005673 | U1 | 5/2000 |
| EP | 2224202 | B1 | 9/2010 |
| ES | 2582980 | A1 | 9/2016 |

* cited by examiner

*Primary Examiner* — Joshua T Semick

(74) *Attorney, Agent, or Firm* — Egbert, McDaniel & Swartz, PLLC

(57) ABSTRACT

A stock for shotgun includes a grip suitable for being held by the user, a butt suitable for being placed on a shoulder of the user, a hollow body fixed to the grip, a shank fixed to the butt and suitable for being disposed inside the hollow body and fixing means used to fix the shank inside the hollow body. The shank has an external thread. The stock has a metal ring that is crewed onto the external thread of the shank and is suitable for being stopped against an ending edge of the hollow body, in such a way to adjust the distance between the butt and the grip.

8 Claims, 4 Drawing Sheets

STOCK FOR SHOTGUN

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present patent application for industrial invention relates to a stock for shotgun. Generally speaking, a stock for shotgun comprises a grip suitable for being held by the user and a butt suitable for being placed on a shoulder of the user. Considering that the grip is suitable for being held by the user, and the butt is suitable for being placed on the shoulder of the user, the distance between the butt and the grip needs to be adjusted according to the length of the user's arms.

So the distance between the grip and the butt needs to be adjusted according to the physical features of the user.

2. Description of Related Art Including Information Disclosed Under 37 CFR 1.97 and 37 CFR 1.98.

EP2224202 discloses a stock for shotgun, which is shown in FIG. 1 and is indicated with reference numeral (100). The stock (100) comprises a butt (2) suitable for being connected to the barrel of the shotgun and a grip (3) suitable for being held by a user. A hollow body (5) with a serrated internal wall is connected to the grip (3). A serrated tube (106) is connected to the butt (2). In particular, the serrated tube (106) comprises teeth suitable for interfering with the serrated internal wall of the hollow body (5).

The serrated tube (106) telescopically slides inside the hollow body (5) in such a way to adjust the distance between the butt (2) and the grip by pulling or pushing the butt (2) in order to overcome the resistance exerted by the teeth of the serrated tube (106).

The stock (100) of the prior art is impaired by a drawback caused by the fact that the serrated tube (106) does not permit the fine precise adjustment of the distance between the butt (2) and the hollow body (5). As a matter of fact, by pushing the serrated tube (160) inside the hollow body (5) or pulling the serrated tube (106) outwards, it is not possible to adjust the distance between the butt (2) and the hollow body (5) precisely.

Moreover, the minimum sliding of the serrated tube (106) in the hollow body (5) is determined by the pitch between two consecutive teeth of the serrated pipe (106).

US8720099 discloses a buttstock for shotgun comprising a grip suitable for being held by a user, and a butt suitable for being placed on a shoulder of the user. A shank is fixed to the butt and is suitable for being disposed inside a hollow body that is fixed to the grip. A metal ring is screwed onto an external thread of the shank and is suitable for being stopped against an ending edge of the hollow body in such a way to adjust the distance between the butt and the grip.

BRIEF SUMMARY OF THE INVENTION

The purpose of the present invention is to overcome the drawbacks of the prior art by disclosing a stock for shotgun wherein the distance between a butt and a grip can be adjusted precisely.

A stock for shotgun according to the invention comprises a butt and a grip. A hollow body is connected to the grip and a shank is connected to the butt. The shank is suitable for engaging the hollow body. Fixing means are used to fix the shank inside the empty body.

The shank has an external thread. The stock of the invention comprises a metal ring that is screwed onto the external thread of the shank and is stopped against an ending edge of the hollow body in such a way to adjust the distance between the butt and the grip.

After adjusting the distance between the butt and the grip, fixing means are engaged in the hollow body and in the shank to fix the shank to the hollow body.

The advantages of the stock of the invention are evident because the provision of the metal ring allows for adjusting the distance between the shank and the grip finely and precisely.

BRIEF DESCRIPTION OF THE SEVERAL VIEWS OF THE DRAWINGS

For purposes of clarity, the description of the stock according to the invention continues with reference to the attached drawings, which have a merely illustrative, not limiting value, wherein.

DETAILED DESCRIPTION OF THE INVENTION

Figure 1:
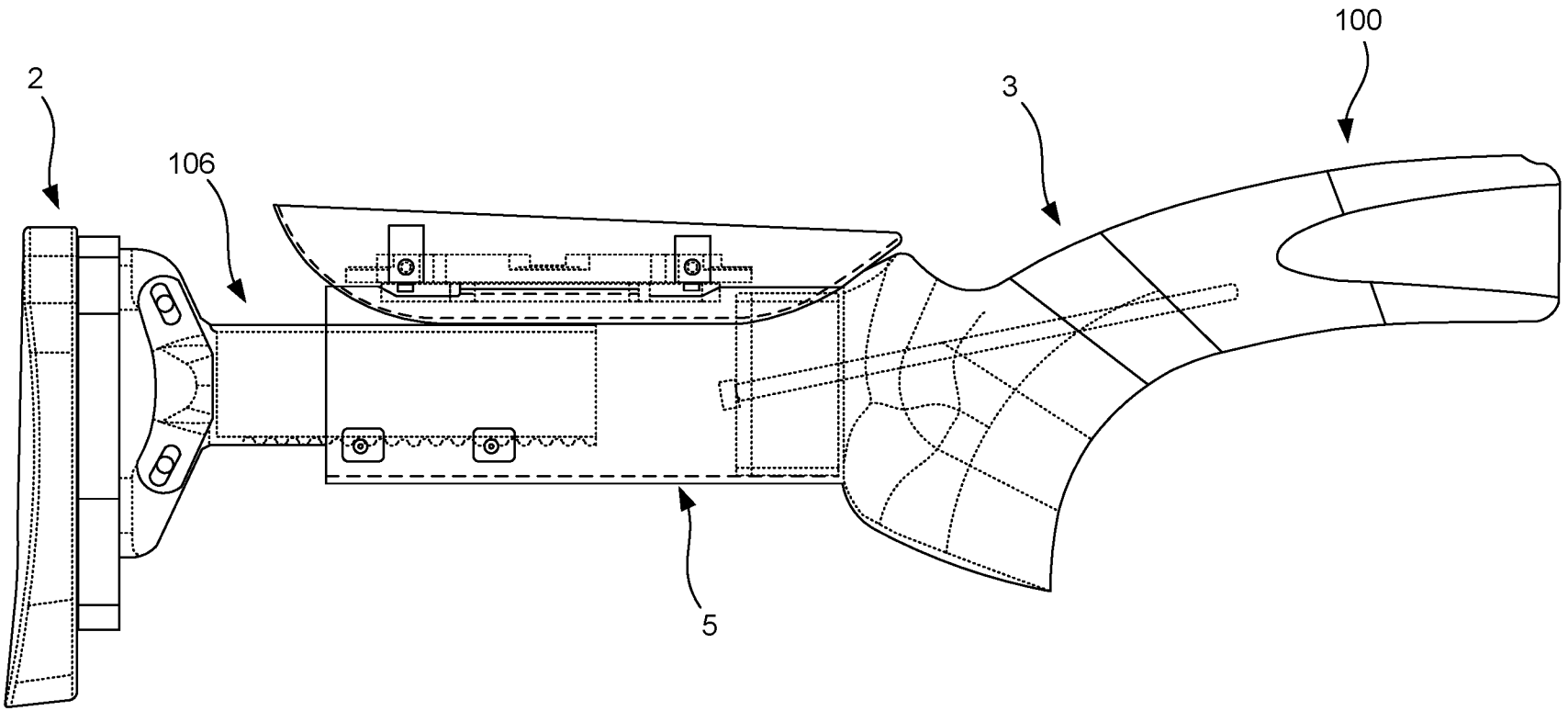
FIG. 1 PRIOR ART
FIG. 1 is a partially sectioned side view of a stock according to the prior art.
Figure 2:
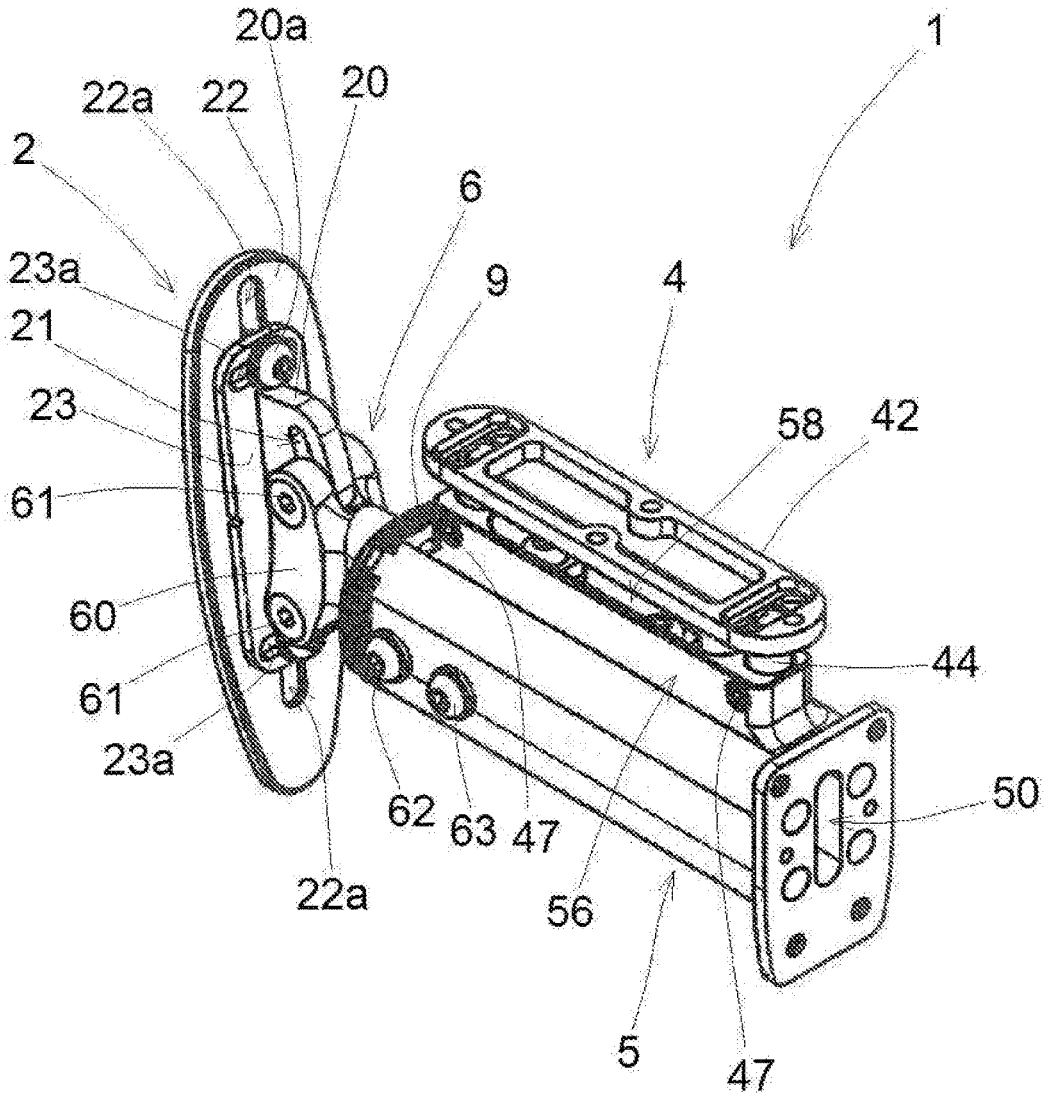
FIG. 2 is an axonometric view of the stock according to the invention.
Figure 3:
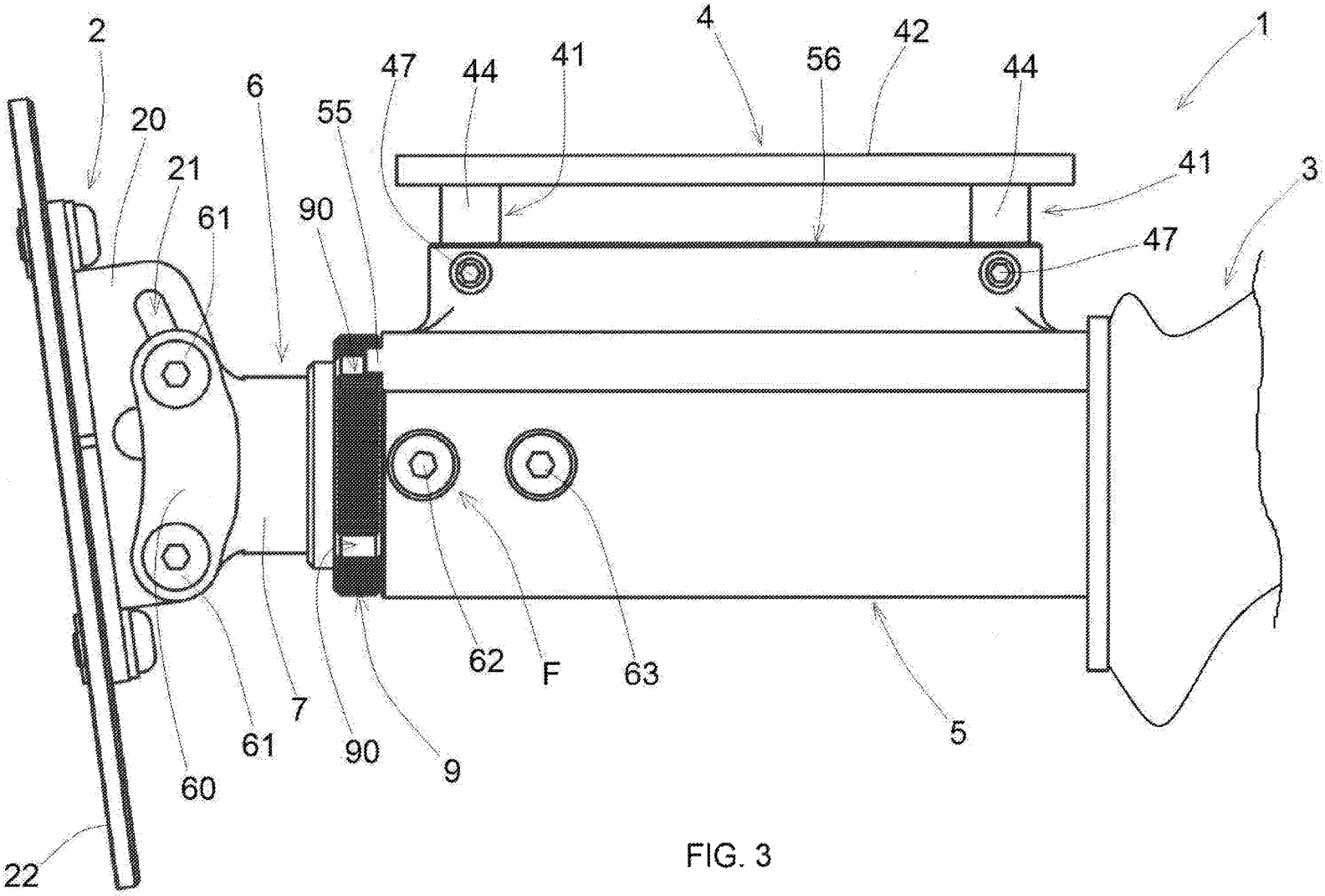
FIG. 3 is a side view of the stock of FIG. 2.
Figure 4:
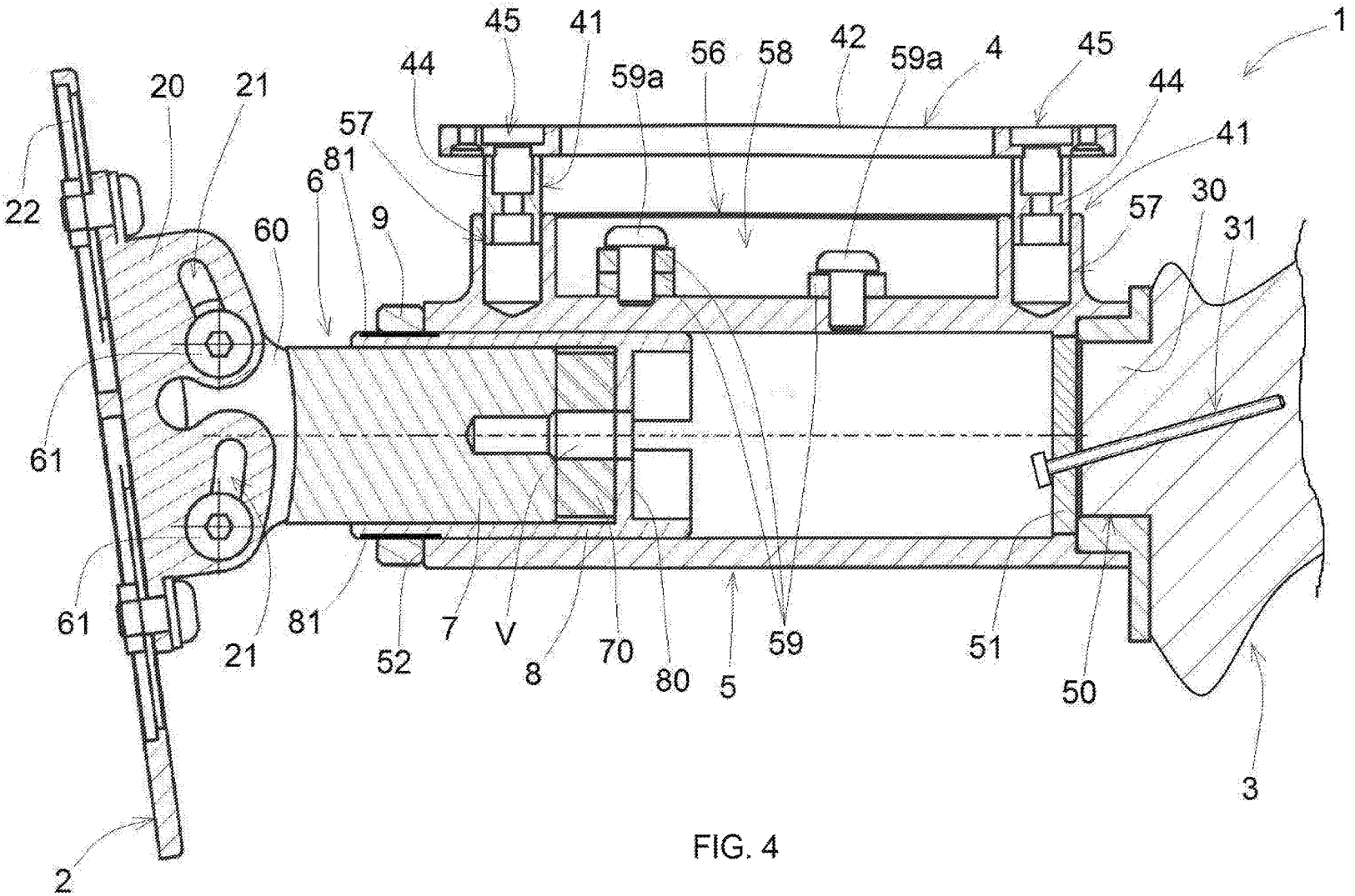
FIG. 4 is longitudinal sectioned view of the stock of FIG. 2.

With reference to FIGS. 2 to 4, a stock for a shotgun according to the invention is disclosed, which is generally indicated with reference numeral (1).

The stock (1) for shotgun comprises a butt (2) and a grip (3). A hollow body (5) is fixed to the grip (3). A shank (6) is fixed to the butt (2). The shank (6) is engaged in the hollow body (5) to adjust the distance between butt (2) and grip (3).

With reference to FIG. 4, the grip (3) comprises a pin (30) that is engaged in an opening (50) of the hollow body (5). The grip (3) is fixed to the hollow body (5) by means of a screw (31) that passes through a wall (51) of the hollow body and is screwed in the pin (30) of the grip.

The stock (1) comprises a cheek piece (4) that protrudes radially from the hollow body (5) and is suitable for being placed in contact with a cheek of a user. The cheek piece (4) comprises a plate (42) that is raised relative to the hollow body (5) to define a support plane of the cheek. Advantageously, as shown in FIG. 4, the cheek piece (4) comprises adjustment means (41) connected to the plate (42) and to the hollow body (5) to adjust the distance of the plate (42) from the hollow body (5), in such a way to align the eye of the shooter with a sight of the shotgun. In particular, said adjustment means (41) comprise a pair of sleeves (44) connected to the plate (42) by means of fixing screws (45) in such a way to protrude from the plate (42).

The hollow body (5) comprises a longitudinal rib (56) that protrudes externally from the hollow body (5). The rib (56) comprises two housings (57) disposed in radial position relative to the hollow body and two threaded holes disposed in radial position relative to the housings (57) and in communication with the housings (57). Each housing (57) slidingly houses a sleeve (44) of the adjustment means (41).

With reference to FIGS. 2 and 3, the adjustment means (41) also comprise two fixing bolts (47) suitable for being screwed in the threaded holes of the housings of the rib (56), in such a way to stop the sliding movement of the sleeves (44) inside the housings (57) of the rib (56).

With reference to FIG. 4, the rib (56) comprises a compartment (58) that contains weights (59) fixed to the external wall of the hollow body (5) with fixing screws (59*a*). The weights (59) are suitable for balancing the stock (1).

With reference to FIG. 2, the butt (2) comprises a plate (22). The plate (22) comprises two slots (22*a*) in aligned position. The butt (2) comprises a strap iron (20) provided on one side with first connection means for connection to said plate (22), and on the other side with second connection means for connection to the shank (6).

Said first connection means consist in a flange (23) that comprises two slots (23*a*), disposed in correspondence of the slots (22*a*) of the plate (22) in transverse position relative to the slots (22*a*) of the plate (22). The plate (22) and the flange (23) are connected by means of two screws (20*a*), each of them being inserted in one of the slots (23*a*) of the flanges 23) and in one of the slots (22*a*) of the plate (22). The provision of slots (22*a*, 23*a*) with such a configuration allows the user to loosen the screws (20*a*), move the plate (22) relative to the strap iron (20), and then re-tighten the screws (20*a*) after finding the desired position of the plate (22). Such movement of the plate (22) can be up-down, right-left, slight rotations in clockwise and anticlockwise direction.

The second connection means comprise two slots (21) obtained on the strap iron (20) and shaped like a circular arc. The shank (6) comprises an ending section provided with two flanges (60) in parallel position. The flanges (60) are shaped in such a way that an empty space is created between the two flanges (60) to house the strap iron (20) of the butt (2). Each flange (60) of the shank comprises two holes that are aligned with the holes of the other flange of the shank. Screws (61) are disposed in the aligned holes of the two flanges (60) of the shank and pass through the slots (21) of the strap iron of the butt. The screws (61) are slidingly mounted in the slots (21) of the strap iron of the butt (2), in such a way to adjust the inclination of the butt (2) relative to the hollow body (5).

The shank (6) is fixed to the hollow body (5) by means of fixing means (F). The fixing means (F) are screws (62, 63) that pass through the hollow body (5) and are radially tightened in a rib of the shank (6).

With reference to FIG. 3, the shank (6) is made of two parts: an internal tube (7) and a sleeve (8) fixed on the internal tube (7). The internal tube (7) is connected to the two flanges (60) of the shank (6). The sleeve (8) is closed on the back by means of a rear wall (80).

A spacer (70) made of soft cushioning material is disposed between the rear wall (80) of the sleeve and the internal tube (7).

The internal tube (7) has an elliptical shape in cross-section and the sleeve (8) has a elliptical longitudinal cavity that houses the internal tube (7). In this way the internal tube (7) cannot rotate relative to the sleeve (8).

A bolt (V) passes through the rear wall (80) and is axially screwed in the internal tube (7), in such a way to fix the sleeve (8) to the internal tube (7). The bolt (V) passes through the rear wall (80) and the spacer (70) and is axially screwed in the internal tube (7). A nut (not shown in the figures) is screwed onto the bolt (V), in such a way to lock the bolt (V). The nut is stopped against the rear wall (80) of the sleeve. The nut is screwed onto the bolt (V) in such a way not to compress the spacer (70).

The spacer (70) can be compressed by a length of approximately 1-3 millimeters In view of the above, when shooting, because of the recoil, the internal tube (7) can slide by approximately 1-3 millimeters relative to the sleeve (8) towards the rear wall (80) of the sleeve, compressing the spacer (70). Therefore the recoil of the shotgun is cushioned by the spacer (70) that is compressed.

The sleeve (8) has an external thread (81). The shotgun (1) also comprises a metal ring (9) that is screwed onto the external thread (81) of the sleeve (8). In this way, the metal ring (63) is stopped against an edge of the hollow body (5), acting as stop to adjust the distance between the butt and the grip.

Such an adjustment provides for extracting the shank (6) from the hollow body (5) and screwing/unscrewing the metal ring (9) on the sleeve (8) in such a way to change the position of the metal ring (9) on the sleeve (8) and consequently the distance between the butt (2) and the grip.

Advantageously, the hollow body (5) comprises teeth (55) that protrude longitudinally from the ending edge (52) of the hollow body (5) that is to be stopped against the metal ring (9). The metal ring (9) comprises grooves (90) suitable for housing the teeth (55) of the hollow body (5) when the metal ring (9) is stopped against the edge of the hollow body (5) in such a way to lock a rotation of the metal ring (9) relative to the hollow body (5).

More precisely, the external thread (81) of the sleeve (8) has a 1 mm pitch, meaning that at every complete turn of the metal ring (9) on the sleeve (8), the metal ring (9) is moved by 1 mm relative to the sleeve (8). The metal ring (9) is provided with four grooves (90) that are equally spaced in such a way to stop the rotation of the metal ring (9) at every fourth of turn of the metal ring (9). Consequently, the minimum distance that can be covered by the metal ring (9) relative to the sleeve (8) is 0.25 mm. The provision of the metal ring (9) makes it possible to finely and precisely adjust the distance of the butt (2) relative to the grip.

Although in the attached figures the shank (6) is shown in two pieces, i.e. internal tube (7) and sleeve (8), it is evident that the shank (6) can be made in one piece. Obviously the shank (6) must be provided with an external thread in order to screw the metal ling (9).

We claim:

1. A stock for a shotgun comprising:

a grip adapted to be held by a user;

a butt adapted to be disposed on a shoulder of the user;

a hollow body affixed to the grip;

a shank affixed to the butt, said shank disposed inside said hollow body, said shank having an external thread;

a fixing means that fixes said shank inside said hollow body; and a metal ring screwed onto the external thread of said shank and stopped against an ending edge of said hollow body so as to adjust a distance between said butt and said grip, wherein said hollow body comprises teeth that protrude longitudinally from the ending edge of said hollow body, said metal ring comprising grooves that house the teeth of said hollow body when said metal ring is stopped against the ending edge of said hollow body so as to block a rotation of said metal ring relative to the hollow body.

2. The stock of claim 1, wherein said shank comprises an internal tube connected to the butt and a sleeve affixed on the internal tube, wherein said external thread is formed on said sleeve.

3. The stock of claim 2, wherein said sleeve comprises a rear wall, the stock further comprising:

a spacer formed of cushioning material that is disposed inside said sleeve between the rear wall and the internal tube.

4. The stock of claim 3, wherein said sleeve is affixed to the internal tube by a bolt that passes through the rear wall and the spacer, said bolt axially screwing in the internal tube, and a nut screwed onto the bolt so as to not compress said spacer.

5. The stock of claim 1, further comprising:

a support element that protrudes radially from said hollow body, said support element comprising a plate that is raised with respect to said hollow body and an adjustment device connected to the plate and to the hollow body adapted to adjust a distance of the plate from said hollow body.

6. The stock of claim 5, wherein said hollow body comprises a rib that protrudes externally from said hollow body, said rib comprising a housing and a threaded hole in communication with the housing, said adjustment device comprising:

a sleeve connected to the plate and slidingly mounted inside the housing of the rib; and a fixing bolt screwed in the threaded hole of the housing so as to block a sliding of the sleeve inside the housing of the rib.

7. The stock of claim 6, wherein the rib comprises a compartment that contains weights, said rib affixed to the external wall of said hollow body with fixing screws.

8. The stock of claim 1, wherein said butt comprises a strap iron with a slot shaped as an arc of a circle, wherein said shank comprises a screw that is slidingly mounted in a slot of said butt so as to adjust a inclination of said butt with respect to said hollow body.

* * * * *